United States Patent [19]

Wickware

[11] 4,023,286

[45] May 17, 1977

[54] RAILROAD SWITCH SWEEPER

[75] Inventor: James L. Wickware, Battle Creek, Mich.

[73] Assignee: N. A. Cobb, Augusta, Mich.

[22] Filed: Sept. 4, 1975

[21] Appl. No.: 610,174

[52] U.S. Cl. ..... 37/14; 37/35; 15/405; 126/271.2 R; 104/279

[51] Int. Cl.[2] ..... E01H 5/10

[58] Field of Search ..... 37/12, 14, 17, 15, 18, 37/35, 29; 104/279; 126/271.1, 271.2 R, 271.2 A, 271.2 C; 15/340, 405, 415

[56] References Cited

UNITED STATES PATENTS

| | | | |
|---|---|---|---|
| 161,718 | 4/1875 | Waterbury | 126/271.2 C |
| 184,628 | 11/1876 | Kendrick | 126/271.1 X |
| 1,192,808 | 7/1916 | Allen | 126/271.2 C |
| 2,543,166 | 2/1951 | Heining | 126/271.2 R |
| 2,560,221 | 7/1951 | Hamblin | 37/12 X |
| 2,566,473 | 9/1951 | Wilson | 126/271.2 R |
| 2,597,719 | 5/1952 | Foster | 104/279 X |
| 2,756,520 | 7/1956 | Soule | 104/279 X |
| 3,270,632 | 9/1966 | Schultz | 126/271.2 C X |
| 3,391,025 | 7/1968 | Foxx et al. | 104/279 X |
| 3,685,454 | 8/1972 | Ogilvy et al. | 104/279 X |

FOREIGN PATENTS OR APPLICATIONS

| | | | |
|---|---|---|---|
| 867,558 | 2/1953 | Germany | 104/279 |
| 185 | 6/1911 | United Kingdom | 37/12 |

*Primary Examiner*—E. H. Eickholt
*Attorney, Agent, or Firm*—Fisher, Gerhardt & Groh

[57] ABSTRACT

A railroad switch sweeper or snow removal machine including a vehicle having a body member supported at a relatively high elevation above the ground by steerable ground engaging wheels. The underside of the body member has a turret mounting a plurality of barrels for delivery of compressed air or flame to blow or melt accumulated snow and ice. The barrels of the air blower and flame thrower are arranged in pairs so that air and flame may be concentrated on each rail of the pair of rails making up a railroad track.

10 Claims, 3 Drawing Figures

Fig-1
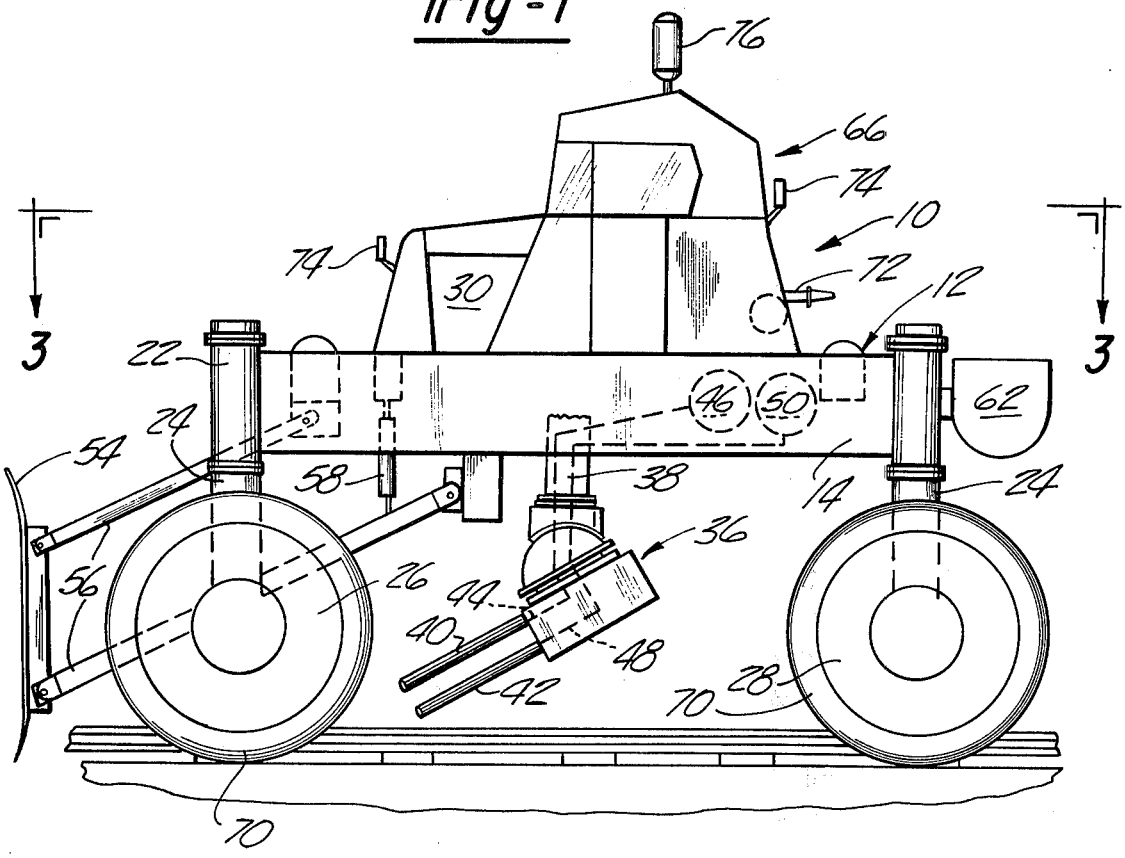
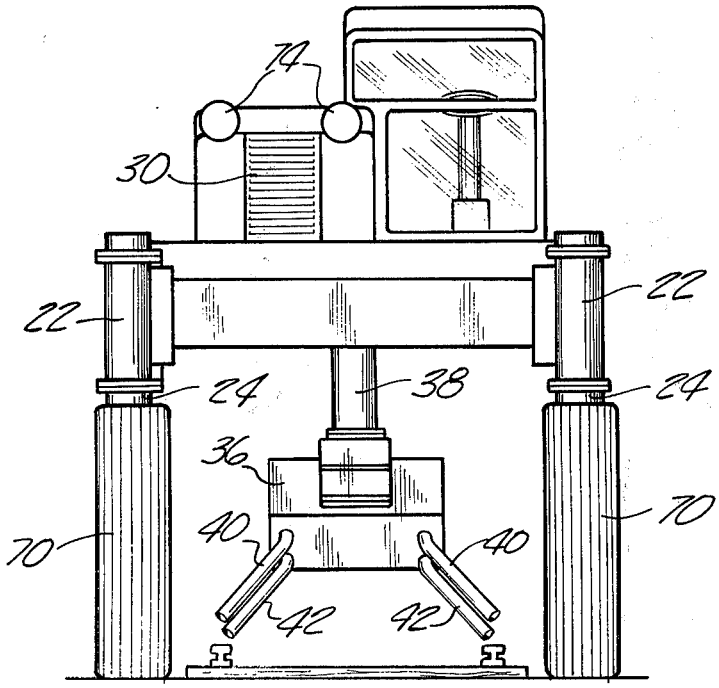
Fig-2

RAILROAD SWITCH SWEEPER

This invention relates to snow removal machinery and particularly to a machine for melting and removing snow from railroad switches and railroad track.

The accumulation of snow, ice and slush in the crevices and recesses of railroad beds, particularly in the area of switches, crossovers, and signal devices, becomes a serious problem, particularly in railroad switching yards.

Various forms of snow removal devices have been provided including devices for melting snow. However, such machines are normally confined to operating on the railroad tracks or are towed by another vehicle. Although such equipment may be adequate for removing the bulk of snow accumulated on railroad beds it is inadequate for removing snow and ice which often becomes lodged in crevices and recesses of railroad switches and the like, making them inoperative.

It is the object of the invention to provide a snow removal machine in the form of a high clearance, all surface vehicle incorporating means for melting and moving snow, ice and slush which may become accumulated in the area of railroad switches.

It is a further object of the invention to provide a snow removal machine incorporating a flame thrower for melting snow and ice accumulation.

Another object of the invention is to provide a snow removal machine for railroad switching yards which incorporates ground engaging steerable wheels so that the machine is not limited to operation on railroad tracks.

The snow removal machine embodying the invention is completely equipped to remove and melt snow particularly from switches in railroad switch yards. The vehicle employs large wheels which permit the vehicle to move independently of the rails of a railroad bed from one switch to another and also act to support the body of the machine in an elevated position above the wheels so that its movement is not obstructed by snow accumulations and to give good visibility to the operation of snow moving equipment such as a snowplow and air and flame thrower barrels at the underside of the body. The vehicle also is equipped with a salt spreader and fire hose to accommodate various operating conditions which may be encountered. A portion of the floor of the operator's station is transparent to further facilitate viewing of operation of the machine.

FIG. 1 is a side elevation showing the snow removal machine embodying the invention;

FIG. 2 is an end elevation of the snow removal machine shown in FIG. 1 with the snowplow removed.

Figure 3:
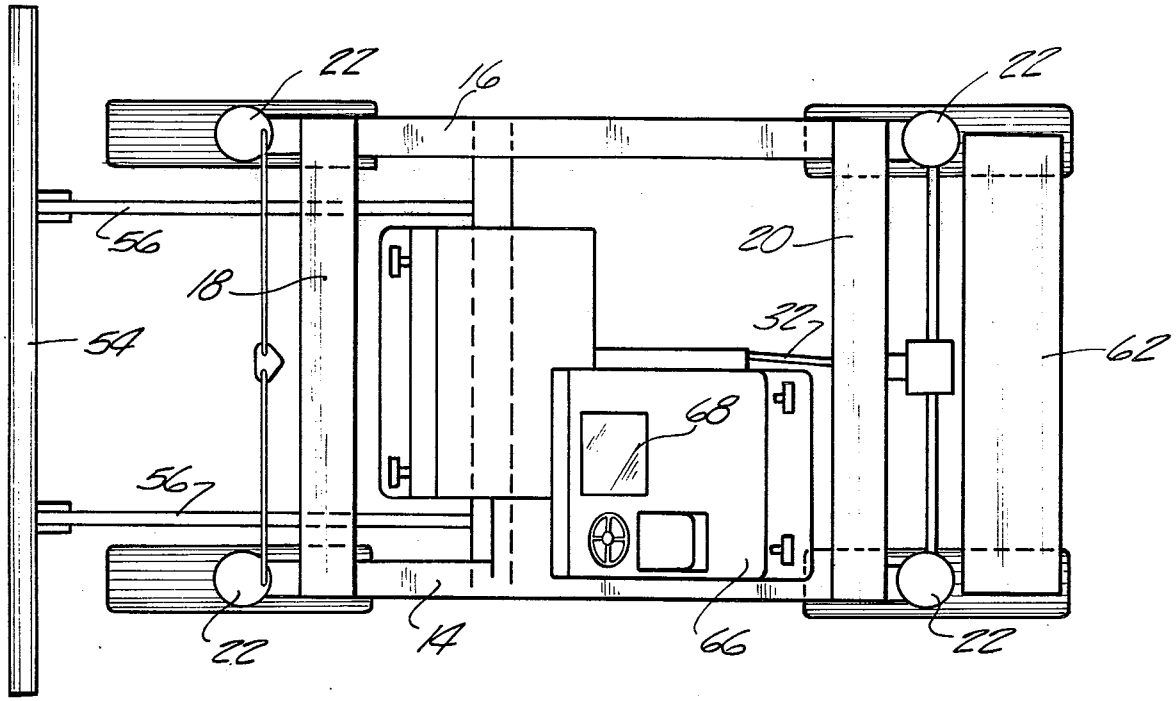
FIG. 3 is a top elevation of the snow removal machine.

A snow removal machine embodying the invention is designated generally at 10 and includes a body member 12 having a frame formed of laterally spaced, side members 14 and 16 and longitudinally spaced cross members 18 and 20 which are welded together to form an integral rectangular frame. Tubular hubs 22 are rigidly connected at each corner of the frame by welding or the like to the ends of the side frame members. Each of the hubs 22 rotatably support a vertically depending shaft 24. The lower ends of the pair of the shafts 24 at the forward end of the vehicle rotatably support a pair of front ground engaging wheels 26 and the pair of shafts 24 at the rear of the vehicle support rear ground engaging wheels 28, at least one of which is a driving wheel.

The wheels 26 and 28 support the body member 12 in an elevated position above the wheels and afford a large clearance space below the body member and between the wheels.

The front wheels 26 are linked together and are steered by pivoting the wheels about the axis of the shafts 24. The rear wheels 28 also may be steerable in the same manner and preferably are so arranged that when the front wheels 26 pivot in one direction, the rear wheels 28 pivot in the opposite direction to decrease the required turning radius of the vehicle.

The frame supports an engine indicated at 30 which is drivingly connected by means of shaft 32 to at least one of the rear ground engaging wheels 28.

Thus far the vehicle described is of the type used to straddle and lift large bulky loads such as stacks of lumber, for example. One such vehicle is made by Clark Equipment Company and is designated Model No. SC200.

Referring to FIGS. 1 and 2, it will be noted that the wheels 26 and 28 are spaced longitudinally and laterally of each other to provide a large open area between the four wheels and below the body 12. Disposed in this space and at the underside of the body is a snow and ice removal assembly, including a turret 36. The turret 36 is suspended by the underside of the body for swinging movement horizontally about the vertical axis of a tubular turret support member 38 which depends vertically from the body member 12. The turret 36 also may be displaced angularly in a vertical plane about a horizontal axis so that the turret 36 provides universal angular displacement relative to the body member 12.

The turret 36 supports a pair of laterally spaced air tubes or barrels 40 and a similarly spaced pair of flame throwers with tubes or barrels 42. The barrels 40 and 42 are so arranged and spaced that one air barrel 40 and one flame thrower barrel 42 are associated with each rail of the pair of rails forming a railroad track. Also, the air barrel 40 is disposed parallel to and slightly above the flame thrower barrel 42 at each side of the turret, as seen in FIG. 2.

The air barrels are supplied with air by way of conduit indicated at 44 from air reservoir 46 to which air is supplied by an engine driven compressor not shown. Fuel for the burner of the flame thrower, which may be napalm or the like, is supplied through a fuel conduit 48 from a fuel reservior 50 supported on the body member 12. Delivery of air to the air barrel 40 and delivery of fuel to the flame thrower 42 are under the control of the operator in his operator station so that the two air barrels and two flame throwers may be operated simultaneously or separately. Controls also are provided for controlling power driven movement of the turret 36 so that the barrels 40 and 42 may be aimed or directed at locations to be cleared of snow or ice.

The machine 10 is provided with a snowplow or blade 54 at the forward end of the vehicle. The snowplow 54 is movable between a working position and an elevated transport position by means of parallel linkages 56 and a hydraulic actuator 58 under the control of the operator.

The rearward portion of the vehicle may be provided with a salt spreader 62 extending generally transversely at the rear of the vehicle.

Disposed at the upper side of the vehicle body and preferably to one side, is a vehicle cab 66 which forms the operator's station and houses the various controls for the vehicle and for the accessories such as the snowplow 54 and turret 36. As indicated in FIG. 3 at 68, it is preferred that at least a portion of the floor of the cab be transparent to afford visibility to the area below the body member 12 and between the wheels 26 and 28, all of which are provided with snow tires 70 for traction in snow covered areas.

The machine may also be provided with flexible firehose 72 for use in controlling any fires which may be ignited during use of the flame throwers 42.

The machine includes lighting arrangements indicated at 74 and 76 for the purpose of illuminating the work area and path of travel as well as for signaling.

The machine 10 is particularly adapted for use in railroad switch yards having complex track arrangements including crossovers, switches and signal devices which tend to become clogged with snow, slush and ice and to become inoperative. The transverse spacing of the wheels 26 and 28 is such that the machine may straddle parallel tracks for movement in the direction of the tracks. The large wheels also make it possible to roll over the tracks for movement across road beds to various locations requiring cleaning.

In most instances, the directing of air at high velocity through the barrels 40 is sufficient to displace the accumulation of snow from crevices and recesses. However, packed snow and ice which resists removal is melted by actuating the flame thrower and directing flame on the tracks. The flame thrower not only melts snow and ice but blows the melted material away from the area to be cleared.

One air barrel 40 and one flame thrower barrel 42 is associated with each rail of a pair of rails forming a road bed so that a pair of rails may be cleaned simultaneously. However, a selected one of the barrels may be operated independently of the remaining barrels when only one rail requires sweeping or cleaning.

Because of the high clearance of the body from ground surface and the large ground supporting wheels, the vehicle may be driven transversely of tracks and moved from one switch to another without the need to follow the track patterns in the railroad switch yard. The snowplow at the front of the vehicle can be used to remove the snow accumulation above track level and after the remaining snow and ice have been melted, as previously described, the salt spreader may be used to deposit salt to inhibit refreezing of any moisture remaining in the clear area.

A completely self-contained machine has been provided for removal of snow and ice particularly from switches in railroad switch yards in which the vehicle employs large wheels supporting the body of the machine in an elevated position above the ground surface, making it possible for the machine to move over the surface independently of the tracks. The underside of the body supports air blowing and flame directing barrels which may be aimed at switch or track areas to be cleared to melt and blow away accumulation of ice and snow.

The embodiments of the invention in which an exclusive property or privilege is claimed are defined as follows:

1. A machine for removing snow from a surface including rails of a railroad track comprising; a body member, ground engaging wheels spaced laterally and longitudinally and supporting said body member in an elevated position relative to said surface and above said wheels, said wheels being spaced laterally a distance greater than the width of said railroad track, means including a flame thrower mounted at the underside of said body member laterally and longitudinally intermediate said wheels, said flame thrower having an elongated barrel mounted for universal angular displacement relative to and at the underside of said body member, and means for moving said barrel to selected angular positions relative to said body member to heat and melt snow on said surface.

2. The combination of claim 1 in which all of said ground engaging wheels are supported relative to said body member for pivoting about vertical axes, and steering means connected to said wheels for pivoting the latter about said axes.

3. The combination of claim 1 in which said body member supports a power plant and means drivingly connecting at least one of said wheels to said power plant for propelling said machine.

4. The combination of claim 1 and further comprising an elongated duct for conveying high pressure air, said duct being mounted at the underside of said body member for relative universal angular displacement relative to said body member and means for moving said duct to selected angular positions relative to said body member for directing high pressure air towards said surface.

5. The combination of claim 1 in which said means is a turret mounted at the underside of said body member for rotation in a horizontal plane, said barrel of said flame thrower being supported on said turret for vertical angular movement relative to said turret.

6. The combination of claim 5 and further comprising; a source of high pressure air on said body member and an elongated air duct having an open end and being mounted parallel to said barrel for directing high pressure air from said source to the surface.

7. The combination of claim 1 in which said barrel is located to have its discharge end aimed at one rail of a pair of rails of a railroad track and further comprising a second barrel having its discharged end laterally spaced from said first mentioned barrel for movement therewith and to be aimed at the other rail of said pair of rails.

8. A machine for removing snow from a surface including rails of a railroad track comprising; a vehicles including a generally rectangular body member, a first pair of ground engaging wheels disposed at each forward corner of said rectangular body member, a pair of second ground engaging wheels disposed at each rearward corner of said body member, said wheels supporting said body member in an elevated position above said wheels, a power plant supported on an upper side of said body member and drivingly connected to at least one of said wheels for propelling said vehicle, an operator's station at the upper side of said rectangular body member, a flame thrower having an elongated barrel mounted at the underside of said body member and between said corners for universal angular displacement relative thereto to heat and melt snow on said surface.

9. The combination of claim 8 in which said operator's station has a transparent floor portion affording visibility from said operator's station to said flame thrower at the underside of said body portion.

10. The combination of claim 9 and further comprising a snowplow supported at a forward position of said vehicle for movement between a working and transport position.

* * * * *